US010648348B2

(12) United States Patent
Hafner et al.

(10) Patent No.: US 10,648,348 B2
(45) Date of Patent: May 12, 2020

(54) COATED CERAMIC MATRIX COMPOSITION COMPONENT AND A METHOD FOR FORMING A COATED CERAMIC MATRIX COMPOSITION COMPONENT

(71) Applicant: GENERAL ELECTRIC COMPANY, Schenectady, NY (US)

(72) Inventors: Matthew Troy Hafner, Honea Path, SC (US); Joshua Lee Margolies, Niskayuna, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 252 days.

(21) Appl. No.: 15/623,763

(22) Filed: Jun. 15, 2017

(65) Prior Publication Data

US 2018/0363476 A1 Dec. 20, 2018

(51) Int. Cl.

| | |
|---|---|
| ***F01D 5/28*** | (2006.01) |
| ***F01D 9/04*** | (2006.01) |
| ***F23R 3/00*** | (2006.01) |
| ***F01D 9/02*** | (2006.01) |

(52) U.S. Cl.

CPC ..... *F01D 5/288* (2013.01); *F01D 9/04* (2013.01); *F23R 3/002* (2013.01); *F23R 3/007* (2013.01); *F01D 9/023* (2013.01); *F05D 2220/32* (2013.01); *F05D 2230/311* (2013.01); *F05D 2230/312* (2013.01); *F05D 2230/313* (2013.01); *F05D 2230/314* (2013.01); *F05D 2240/11* (2013.01); *F05D 2240/35* (2013.01); *F05D 2250/75* (2013.01); *F05D 2300/171* (2013.01); *F05D 2300/177* (2013.01); *F05D 2300/2112* (2013.01); *F05D 2300/2261* (2013.01); *F05D 2300/2283* (2013.01); *F05D 2300/6033* (2013.01); *F23R 2900/00018* (2013.01)

(58) Field of Classification Search

None

See application file for complete search history.

(56) References Cited

U.S. PATENT DOCUMENTS

| | | | | |
|---|---|---|---|---|
| 5,355,668 | A * | 10/1994 | Weil | F01D 5/288 60/777 |
| 6,315,519 | B1 | 11/2001 | Bagepalli et al. | |
| 6,758,653 | B2 | 7/2004 | Morrison | |
| 7,181,915 | B2 * | 2/2007 | Ackermann | F01D 5/288 60/770 |
| 2004/0126229 | A1 * | 7/2004 | Ackermann | F23M 5/00 415/200 |

(Continued)

*Primary Examiner* — John J Figueroa

(74) *Attorney, Agent, or Firm* — McNees Wallace & Nurick LLC

(57) ABSTRACT

A coated ceramic matrix composite component and a gas turbine assembly are provided. The coated ceramic matrix composite component comprises a substrate comprising an endface surface and a hot gas path surface. The hot gas path surface is arranged and disposed to contact a hot gas path when the component is installed in the gas turbine assembly. The endface surface is disposed at an endface angle to the hot gas path surface and opposing at least one adjacent component when the component is installed in the gas turbine assembly. The coated ceramic matrix composite component further comprises an environmental barrier coating on at least a portion of the endface surface.

20 Claims, 3 Drawing Sheets

(56) References Cited

U.S. PATENT DOCUMENTS

| | | | | |
|---|---|---|---|---|
| 2016/0108510 | A1* | 4/2016 | Kirby | C23C 4/11<br>428/215 |
| 2017/0167279 | A1* | 6/2017 | Kirby | F01D 11/001 |
| 2017/0356653 | A1* | 12/2017 | Bagchi | F23R 3/002 |

* cited by examiner

COATED CERAMIC MATRIX COMPOSITION COMPONENT AND A METHOD FOR FORMING A COATED CERAMIC MATRIX COMPOSITION COMPONENT

FIELD OF THE INVENTION

The present invention is generally directed to a coated ceramic matrix composite component and a method of forming a coated ceramic matrix composite component. More specifically, the present invention is directed to a ceramic matrix composite component comprising a coated endface surface and a method of forming a ceramic matrix composite component comprising a coated endface surface.

BACKGROUND OF THE INVENTION

Certain components such as ceramic matrix composite (CMC) components for a gas turbine operate at high temperatures and pressures. In particular, recession, off-gassing of silicon hydroxides in the presence of water vapor at high temperatures and pressures, can occur at temperatures above 1500° F. Purge flow may be formed to help cool the surface of components below the recession temperature. However, purge flow may lead to undesirable reduction in turbine aerodynamics and overall turbine efficiency.

BRIEF DESCRIPTION OF THE INVENTION

In an exemplary embodiment, a coated ceramic matrix composite component for a gas turbine is provided. The coated ceramic matrix composite component comprises a substrate comprising an endface surface and a hot gas path surface. The hot gas path surface is arranged and disposed to contact a hot gas path when the component is installed in the gas turbine. The endface surface is disposed at an endface angle to the hot gas path surface and opposing at least one adjacent component when the component is installed in the gas turbine. The coated ceramic matrix composite component further comprises an environmental barrier coating on at least a portion of the endface surface.

In another exemplary embodiment, a gas turbine assembly comprising a plurality of a coated ceramic matrix composite component is provided. The coated ceramic matrix composite component comprises a substrate comprising an endface surface and a hot gas path surface. The hot gas path surface is arranged and disposed to contact a hot gas path. The endface surface is disposed at an endface angle to the hot gas path surface and opposing at least one adjacent component in the gas turbine assembly. The coated ceramic matrix composite component further comprises an environmental barrier coating on at least a portion of the endface surface.

In another exemplary embodiment, a method for forming a coated ceramic matrix composite component for a gas turbine is provided. The method comprises a step of providing a component comprising a substrate comprising an endface surface and a hot gas path surface. The method further comprises a step of forming an environmental barrier coating on at least a portion of the endface surface. The hot gas path surface is arranged and disposed to contact a hot gas path when the component is installed in the gas turbine, and the endface surface is disposed at an endface angle to the hot gas path surface and opposing at least one adjacent component when the component is installed in the gas turbine.

Other features and advantages of the present invention will be apparent from the following more detailed description of the preferred embodiment, taken in conjunction with the accompanying drawings, which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided are exemplary methods and coated ceramic matrix composite components. Embodiments of the present disclosure, in comparison to methods and coated ceramic matrix composite components not utilizing one or more features disclosed herein, provide an environmental barrier coating to the endface surface of the components and prevent recession, thereby prolong the part life.

Figure 1:
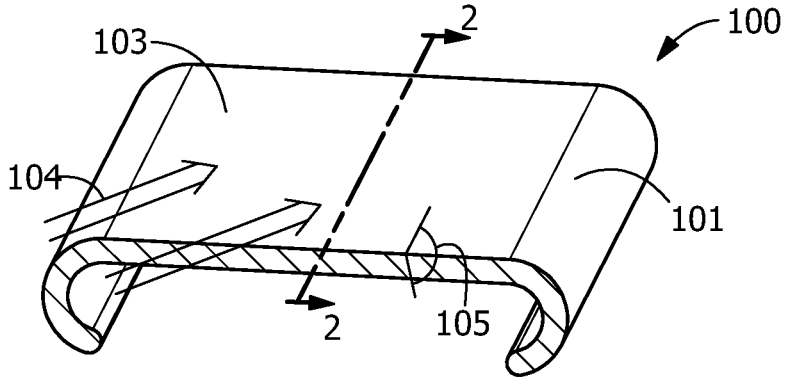
FIG. 1 illustrates a coated ceramic matrix composite component (shroud) according to the present disclosure.

With reference to FIG. 1, a coated ceramic matrix composite component 100 for a gas turbine is provided. Coated ceramic matrix composite component 100 comprises a substrate 101 comprising an endface surface 102 and a hot gas path surface 103. Hot gas path surface 103 is arranged and disposed to contact a hot gas path 104 when the component is installed in the gas turbine. Endface surface 102 is disposed at an endface angle 105 to hot gas path surface 103 and opposes at least one adjacent component when the component is installed in the gas turbine. Endface angle 105 is defined as an angle between a plane oriented along hot gas path surface 103 and a plane oriented along endface surface 102.

Figure 2:
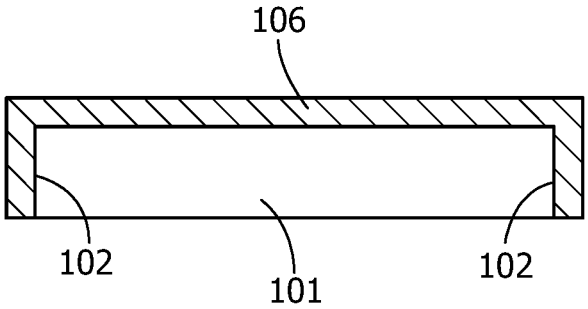
FIG. 2 illustrates a sectional view taken at the line 2-2 in FIG. 1.

With reference to FIG. 2, a sectional view taken at the line 2-2 in FIG. 1 is provided. Coated ceramic matrix composite component 100 comprises an environmental barrier coating 106 on at least a portion of endface surface 102. In one embodiment, environmental barrier coating 106 is disposed on an entire surface of endface surface 102.

In one embodiment, substrate 101 comprises a ceramic matrix composite material selected from the group consisting of carbon-fiber-reinforced silicon carbide (C/SiC), silicon-carbide-fiber-reinforced silicon carbide (SiC/SiC), carbon-fiber-reinforced silicon nitride ($C/Si_3N_4$), silicon nitride-silicon carbide composite ($Si_3N_4/SiC$), alumina-fiber-reinforced alumina ($Al_2O_3/Al_2O_3$), and combinations thereof.

In one embodiment, environmental barrier coating 106 comprises a bond coat and a top coat. In another embodiment, environmental barrier coating 106 consists of a bond coat and a top coat. In another embodiment, environmental barrier coating 106 comprises a bond coat and multiple top coats. In another embodiment, environmental barrier coating 106 consists of a bond coat and multiple top coats. In another embodiment, environmental barrier coating 106 comprises multiple bond coats and a top coat. In another embodiment, environmental barrier coating 106 consists of multiple bond coats and a top coat. In another embodiment, environmental barrier coating 106 comprises multiple bond coats and multiple top coats. In another embodiment, environmental barrier coating 106 consists of multiple bond coats and multiple top coats. In another embodiment, environmental barrier coating 106 comprises at least one bond coat, at least one thermally grown oxide layer and at least one top coat. In another embodiment, environmental barrier coating 106 consists of at least one bond coat, at least one thermally grown oxide layer and at least one top coat.

In one embodiment, suitable bond coat comprises a material selected from the group consisting of silicon, silicon-based alloy, silicon-based composite, silicon dioxide, MCrAlY and combinations thereof; wherein M is Ni, Co, Fe, or mixtures thereof. A person skilled in the art will appreciate that any suitable bond coat materials are envisaged.

In one embodiment, environmental barrier coating 106 further comprises a transition layer comprising a material selected from the group consisting of barium strontium alumino silicate (BSAS), mullite, yttria-stabilized zirconia, $(Yb,Y)_2Si_2O_7$, rare earth monosilicates and disilicates and combinations thereof. A person skilled in the art will appreciate that any suitable EBC materials are envisaged.

In one embodiment, suitable top coat comprises a material selected from the group consisting of $Y_2SiO_5$, barium strontium alumino silicate (BSAS), yttria-stabilized zirconia, yttria-stabilized hafnia, yttria-stabilized zirconia with additions of one or more rare earth oxides, yttria-stabilized hafnia with additions of one or more rare earth oxides and combinations thereof. A person skilled in the art will appreciate that any suitable top coat materials are envisaged.

In one embodiment, coated ceramic matrix composite component 100 is a turbine component. Coated ceramic matrix composite component 100 may be selected from the group consisting of shrouds, nozzles, blades, combustors, combustor transition pieces, combustor liners, combustor tiles and combinations thereof. In one embodiment, coated ceramic matrix composite component 100 is a shroud. A person skilled in the art will appreciate that any suitable coated ceramic matrix composite components are envisaged.

Figure 3:
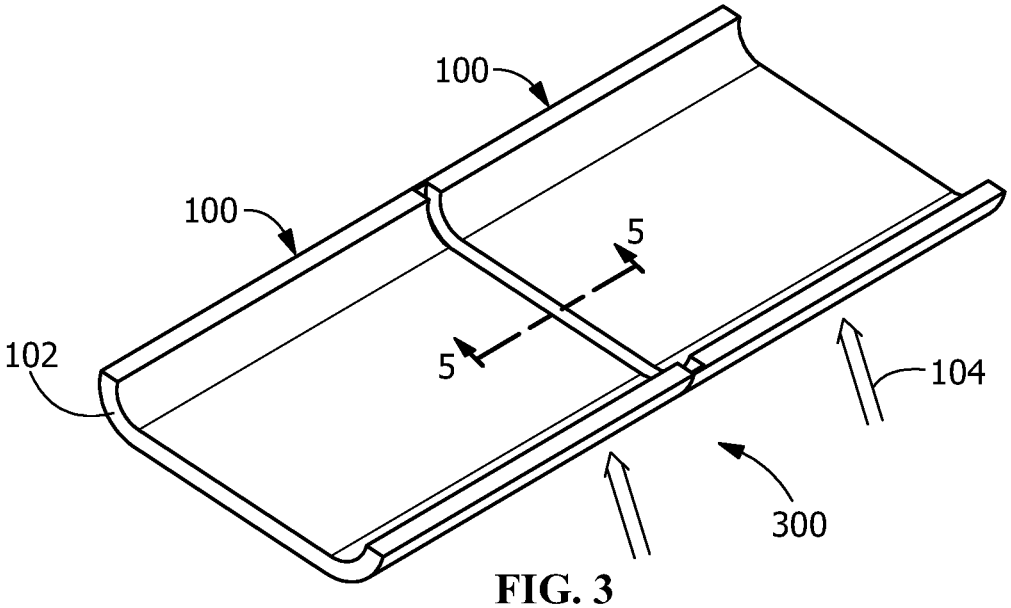
FIG. 3 illustrates a gas turbine assembly comprising a plurality of a coated ceramic matrix composite component (shroud) according to the present disclosure.

With reference to FIG. 3, a gas turbine assembly 300 is provided. Gas turbine assembly 300 comprises a plurality of a coated ceramic matrix composite component 100. The plurality of the coated ceramic matrix composite component comprises substrate 101 comprising endface surface 102 and hot gas path surface 103. Hot gas path surface 103 is arranged and disposed to contact hot gas path 104.

Figure 5:
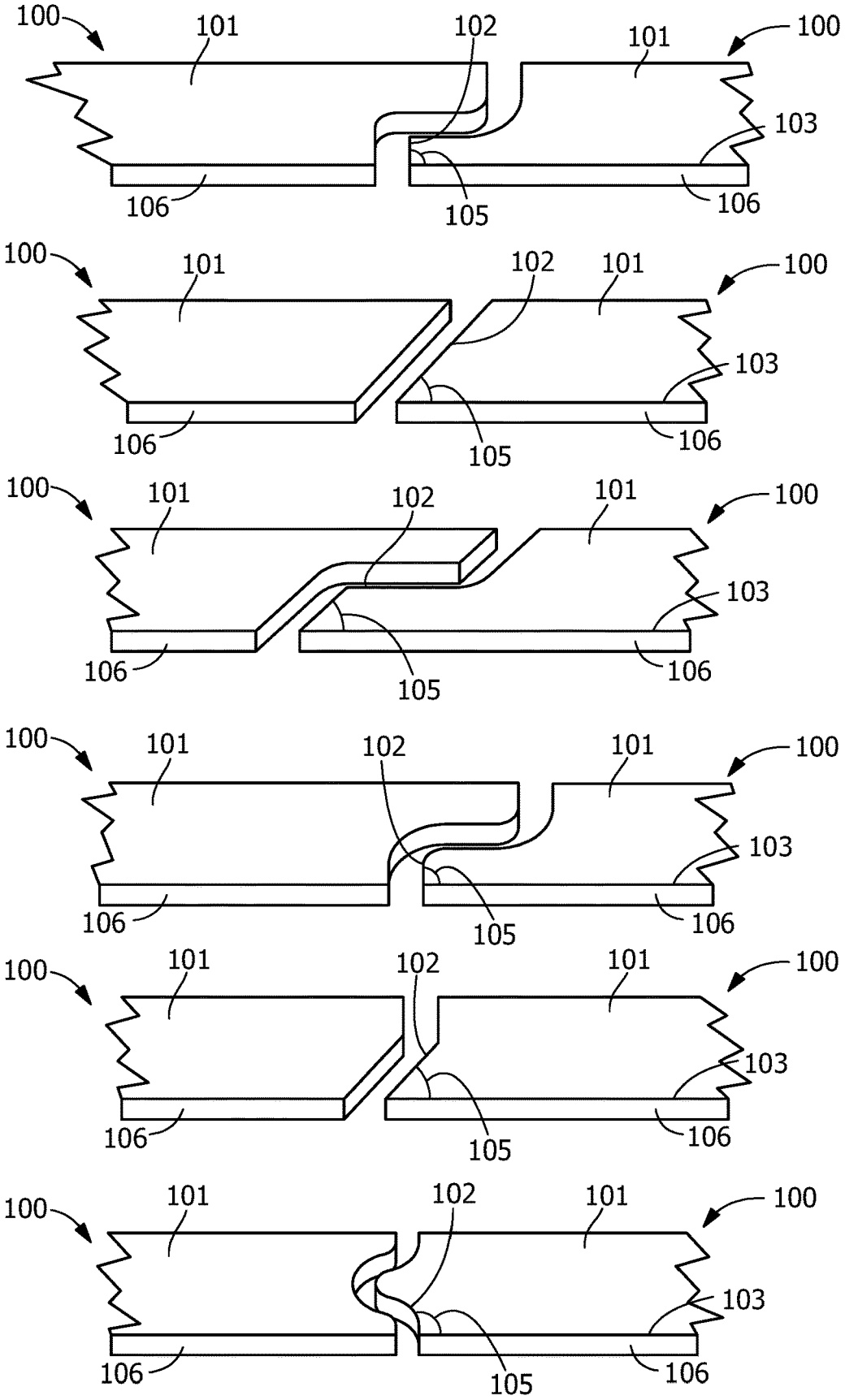
FIG. 5 illustrates a sectional view of coated ceramic matrix composite components according to the present disclosure taken at the line 5-5 in FIG. 3.

With reference to FIG. 5, a sectional view of multiple coated ceramic matrix composite components taken at the line 5-5 in FIG. 3. is provided. Each embodiment includes a different endface angle 105. In one embodiment, endface angle 105 is from about 30 to about 90 degrees, from about 40 to about 80 degrees, from about 50 to about 70 degrees, or about 60 degrees, including increments, intervals, and sub-range therein.

Figure 4:
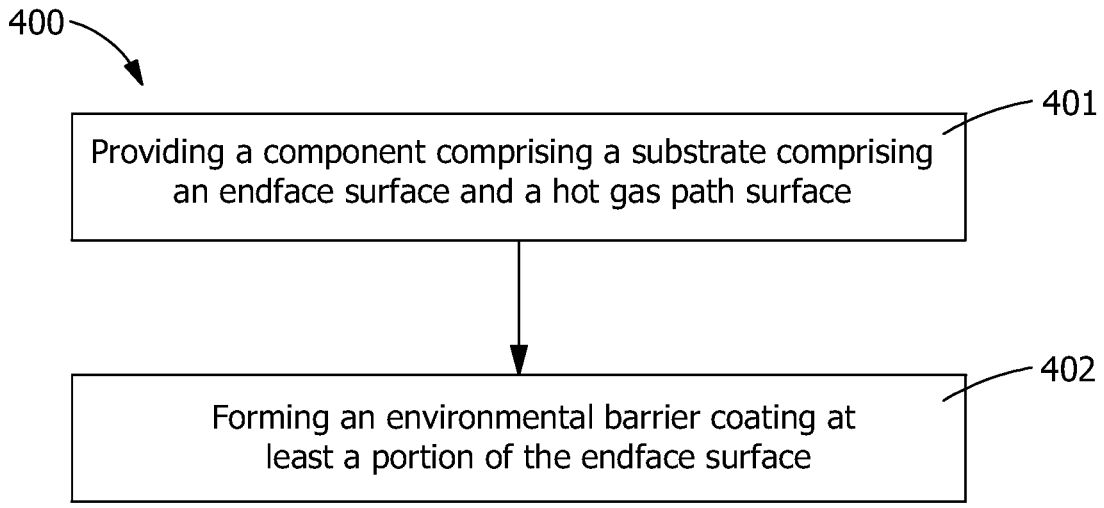
FIG. 4 illustrates a flow diagram of a process for forming a coated ceramic matrix composite component (shroud) for a gas turbine according to the present disclosure.

With reference to FIG. 4, a method 400 for forming a coated ceramic matrix composite component 100 for a gas turbine is provided. Method 400 comprises a step of providing a component comprising a substrate 101 comprising an endface surface 102 and a hot gas path surface 103 (step 401). Method 400 further comprises a step of forming an environmental barrier coating 106 on at least a portion of endface surface 102 (step 402). Hot gas path surface 103 is arranged and disposed to contact a hot gas path 104 when component 100 is installed in the gas turbine, and endface surface 102 is disposed at an endface angle 105 to hot gas path surface 103 and opposing at least one adjacent component when component 100 is installed in the gas turbine.

In one embodiment, the step of forming the environmental barrier coating comprises at least one of physical vapor deposition, chemical vapor deposition, plasma-enhanced chemical vapor deposition, air plasma spray, vacuum plasma spray, combustion spraying with powder or rod, slurry coating, sol gel, dip coating, electrophoretic deposition and tape casting.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A coated ceramic matrix composite component for a gas turbine, comprising:

a substrate comprising an endface surface and a hot gas path surface, the hot gas path surface being arranged and disposed to contact a hot gas path when the component is installed in the gas turbine, and the endface surface being disposed at an endface angle to the hot gas path surface and opposing at least one adjacent component when the component is installed in the gas turbine; and an environmental barrier coating on at least a portion of the endface surface.

2. The coated ceramic matrix composite component of claim 1, wherein the coated ceramic matrix composite component is selected from the group consisting of shrouds, nozzles, blades, combustors, combustor transition pieces, combustor liners, combustor tiles and combinations thereof.

3. The coated ceramic matrix composite component of claim 1, wherein the endface angle is from about 30 to about 90 degrees.

4. The coated ceramic matrix composite component of claim 1, wherein the substrate comprises a ceramic matrix composite material selected from the group consisting of carbon-fiber-reinforced silicon carbide (C/SiC), silicon-carbide-fiber-reinforced silicon carbide (SiC/SiC), carbon-fiber-reinforced silicon nitride ($C/Si_3N_4$), silicon nitride-silicon carbide composite ($Si_3N_4/SiC$), alumina-fiber-reinforced alumina ($Al_2O_3/Al_2O_3$), and combinations thereof.

5. The coated ceramic matrix composite component of claim 1, wherein the environmental barrier coating comprises a bond coat and one or multiple top coats.

6. The coated ceramic matrix composite component of claim 5, wherein the bond coat comprises a material selected from the group consisting of silicon, silicon-based alloy, silicon-based composite, silicon dioxide, MCrAlY and combinations thereof; wherein M is Ni, Co, Fe, or mixtures thereof.

7. The coated ceramic matrix composite component of claim 5, wherein the environmental barrier coating further comprises a transition layer comprising a material selected from the group consisting of barium strontium alumino silicate (BSAS), mullite, yttria-stabilized zirconia, $(Yb,Y)_2Si_2O_7$, rare earth monosilicates and disilicates and combinations thereof.

8. The coated ceramic matrix composite component of claim 5, wherein the top coat comprises a material selected from the group consisting of $Y_2SiO_5$, barium strontium alumino silicate (BSAS), yttria-stabilized zirconia, yttria-stabilized hafnia, yttria-stabilized zirconia with additions of one or more rare earth oxides, yttria-stabilized hafnia with additions of one or more rare earth oxides and combinations thereof.

9. A gas turbine assembly comprising:

a coated ceramic matrix composite component comprising:

a substrate comprising an endface surface and a hot gas path surface, the hot gas path surface being arranged and disposed to contact a hot gas path, and the endface surface being disposed at an endface angle to the hot gas path surface; and an environmental barrier coating on at least a portion of the endface surface; and at least one adjacent component, wherein the endface surface is disposed opposing the at least one adjacent component.

10. The gas turbine assembly of claim 9, wherein the coated ceramic matrix composite component is selected from the group consisting of shrouds, nozzles, blades, combustors, combustor transition pieces, combustor liners, combustor tiles and combinations thereof.

11. A method for forming a coated ceramic matrix composite component for a gas turbine, comprising:

providing a component comprising a substrate comprising an endface surface and a hot gas path surface; and forming an environmental barrier coating on at least a portion of the endface surface;

wherein the hot gas path surface is arranged and disposed to contact a hot gas path when the component is installed in the gas turbine, and the endface surface is disposed at an endface angle to the hot gas path surface and opposing at least one adjacent component when the component is installed in the gas turbine.

12. The method of claim 11, further comprising a step of pretreating the endface surface.

13. The method of claim 11, wherein the step of forming the environmental barrier coating comprises at least one of physical vapor deposition, chemical vapor deposition, plasma-enhanced chemical vapor deposition, air plasma spray, vacuum plasma spray, combustion spraying with powder or rod, slurry coating, sol gel, dip coating, electrophoretic deposition and tape casting.

14. The method of claim 11, wherein the coated ceramic matrix composite component is a turbine component.

15. The method of claim 11, wherein the coated ceramic matrix composite component is selected from the group consisting of shrouds, nozzles, blades, combustors, combustor transition pieces, combustor liners, combustor tiles and combinations thereof.

16. The method of claim 11, wherein the substrate comprises a ceramic matrix composite material selected from the group consisting of carbon-fiber-reinforced silicon carbide (C/SiC), silicon-carbide-fiber-reinforced silicon carbide (SiC/SiC), carbon-fiber-reinforced silicon nitride ($C/Si_3N_4$), silicon nitride-silicon carbide composite ($Si_3N_4$/SiC), alumina-fiber-reinforced alumina ($Al_2O_3/Al_2O_3$), and combinations thereof.

17. The method of claim 11, wherein forming the environmental barrier coating comprises applying a bond coat and one or multiple top coats.

18. The method of claim 17, wherein the bond coat comprises a material selected from the group consisting of silicon, silicon-based alloy, silicon-based composite, silicon dioxide, MCrAlY and combinations thereof; wherein M is Ni, Co, Fe, or mixtures thereof.

19. The method of claim 17, wherein the environmental barrier coating further comprises a transition layer comprising a material selected from the group consisting of barium strontium alumino silicate (BSAS), mullite, yttria-stabilized zirconia, $(Yb,Y)_2Si_2O_7$, rare earth monosilicates and disilicates and combinations and combinations thereof.

20. The method of claim 17, wherein the top coat comprises a material selected from the group consisting of $Y_2SiO_5$, barium strontium alumino silicate (BSAS), yttria-stabilized zirconia, yttria-stabilized hafnia, yttria-stabilized zirconia with additions of one or more rare earth oxides, yttria-stabilized hafnia with additions of one or more rare earth oxides and combinations thereof.

* * * * *